US005475994A

United States Patent [19]

Briley, Jr. et al.

[11] Patent Number: 5,475,994

[45] Date of Patent: Dec. 19, 1995

[54] HIGH SECURITY GUN LOCK DEVICE

[76] Inventors: William P. Briley, Jr., 1789 N. Carpenter Rd., Titusville, Fla. 32796; George T. Croft, 39 Acorn Ln., Hilton Head Island, S.C. 29928; Robert E. Schmeck, 111 Winty Point Cir., Marathon, Fla. 33050

[21] Appl. No.: 89,495

[22] Filed: Jul. 12, 1993

Related U.S. Application Data

[62] Division of Ser. No. 848,341, Mar. 9, 1992, Pat. No. 5,239,767.

[51] Int. Cl.[6] ..... E05B 17/00; E05B 67/36

[52] U.S. Cl. ..... 70/34; 70/330; 70/311; 42/70.11

[58] Field of Search ..... 70/14, 18, 34, 70/23, 330, 57, 58, 386, 387, 438, 311, 312, 320, 321, 329; 42/1.13, 44, 66, 70.01, 70.11, 96, 79

[56] References Cited

U.S. PATENT DOCUMENTS

| | | | |
|---|---|---|---|
| 1,911,559 | 5/1933 | Dyson | 70/330 |
| 2,018,745 | 10/1935 | Schlitz | 70/34 X |
| 3,017,761 | 1/1962 | Pleterski | 70/286 |
| 3,137,957 | 6/1964 | Ingalls | 42/70.11 |
| 3,193,959 | 7/1965 | Jaycox | 42/70.11 |
| 3,360,880 | 1/1968 | Finnegan | 42/66 |
| 3,768,189 | 10/1973 | Goodrich | 70/57 X |
| 4,058,992 | 11/1977 | Nielsen, Jr. | 70/34 |
| 4,398,366 | 8/1983 | Wernicki | 42/70.11 |
| 4,512,099 | 4/1985 | Mathew | 42/70.11 |
| 4,783,924 | 11/1988 | Thurber | 42/70.11 |
| 4,908,971 | 3/1990 | Chaney | 42/70.11 |
| 5,171,924 | 12/1992 | Honey et al. | 42/66 X |
| 5,239,767 | 8/1993 | Briley, Jr. et al. | 42/70.11 |
| 5,289,653 | 3/1994 | Szebeni et al. | 42/70.11 |

*Primary Examiner*—Peter M. Cuomo
*Assistant Examiner*—Suzanne L. Dino
*Attorney, Agent, or Firm*—Martin D. Wittstein

[57] ABSTRACT

A high security gun lock device is disclosed which has an elongate gripping and locking assembly that is inserted into the muzzle end of the barrel of a revolver or pistol type hand gun and which is then connected to a dummy round located in a cylinder chamber of the revolver or the firing chamber of the pistol. The dummy round has a bulbous head which is grasped by a plurality of expandable gripping fingers mounted on the inner end of the gripping and locking assembly to lock the latter to the former. An axially slidable actuating mechanism is manually operable to cause the gripping fingers to release the bulbous head of the bullet, and a spring biased interposer is normally operable to prevent movement of the actuating mechanism until a locking mechanism is set to a predetermined condition to permit operation of the interposer. The locking mechanism has features of construction which permit it to be manually operated solely by tactile perception of relatively movable parts, thereby allowing the gun lock device to be operated in the dark. An enhanced version of the dummy round provides for axial elongation and radial expansion of the bullet so that it jams in the inner end of the gun barrel if any attempt is made to forcibly removed the gripping and locking assembly from the gun without properly unlocking it.

6 Claims, 5 Drawing Sheets

HIGH SECURITY GUN LOCK DEVICE

This application is a division of Ser. No. 848,341 filed Mar. 9, 1992 which is now U.S. Pat. No. 5,239,767.

BACKGROUND OF THE INVENTION

1. Field of the Invention

The present invention relates generally to the field of gun lock devices, and more particularly to a high security gun lock device which can be attached to a revolver or automatic pistol type hand gun to render the gun completely inoperable by an unauthorized person regardless of whether the gun is loaded or unloaded.

As is generally known, there is such a proliferation of hand guns in use by the civilian population that it has become a national problem of major import. Hardly a day passes when the news media does not report the occurrence of a serious crime or suicide committed with the use of a hand gun, or the injury or death of an individual from an accidental gun shot wound. Hand guns typically appear at the focal point of many situations which result in serious injury or death, such as drug related crimes, racial violence, ordinary street crime, domestic quarrels and suicide, to mention a few. The United States civilian population has become the greatest gun culture in the world among developed countries, and is paying a staggering price in injuries and deaths.

Illustrative of the magnitude of the problem, various surveys taken from time to time concerning the firearm population in the United States report that there are at present in excess of 200 million firearms of all types in the hands of civilians, and approximately 5 million additional firearms are purchased each year. Of this total, approximately one third, or 60 to 70 million, are hand guns, with exponential increases over the past three decades. One of two households across the Country owns a hand gun, of which a substantial proportion keep their guns both loaded and readily available, i.e., not under any form of security, regardless of whether the security is a lock device attachable to the gun or the gun is placed in a secure location. And in the past decade, women have become a major purchaser of hand guns for their personal protection both in and out of the home. These surveys define hand guns as small concealable firearms which can be fired with one hand and which fire consecutive rounds from a built in rotating cylinder or grip stored magazine, such as with revolvers and pistols.

Various other surveys report the significance of this firearm population in terms of the injury and death that result from the use of these firearms. Injuries resulting from either the intentional or unintentional use of firearms constitute the second leading cause of death due to injury, exceeded only by death from motor vehicle accidents. For example, there are at least 40,000 deaths annually from all firearms, with about 50% of this number resulting from hand guns. Of the remaining approximately 20,000 deaths, about 55% are suicides, 40% homicides and 5% unintentional. It is noteworthy that over half of the more than 30,000 suicides annually are committed with hand guns. The risk of firearm death is highest for adolescents and young adults, and among children aged 14 and younger firearms are the fourth leading cause of unintentional death. It is axiomatic that with a given probability of both intentional and unintentional woundings and deaths associated with firearms, the ever increasing number of firearms in civilian hands will result in a correspondingly increasing number of such wounding and deaths, all other factors being constant, for the population as a whole.

Two major factors to be derived from the foregoing information form the basis for the present invention. One is the need and intent in today's society of the civilian population to be able to defend itself in time of need with the use of hand guns; the other is the need to achieve a significant reduction in the number of injuries and deaths resulting from the use of these guns. Various measures have been tried and adopted from time to time in an effort to achieve this objective, with varying degrees of success, but thus far no panacea has been found, nor is it likely that one exists. However, the present invention is directed principally toward affecting a significant reduction in the number of injuries and deaths resulting from accidental or unintentional discharge of a hand gun from the following common situations, among others: (a) children playing with loaded hand guns which are accessible to them; (b) children committing suicide with hand guns which are directly accessible to them or are obtained from others; (c) unintentional shooting committed in the extreme stress of a highly emotional situation; (d) any shooting carried out with a stolen hand gun; and (e) any other situation where a shooting could have been prevented by rendering the gun inoperable and useless by anyone but the authorized owner or user.

2. Background Technology

It has been generally recognized among gun safety specialists that the concept of hand gun safety is inversely related to the concept of hand gun utility. In other words, a totally safe hand gun, utilizing existing devices, is a totally useless one, and a readily useful hand gun is one totally lacking in safety. For example, the pistol lying on the night table, loaded and cocked is 100% useful and 0% safe, in terms of accidental, inadvertent or unauthorized use of the weapon. Conversely, the same pistol locked in a display case with no ammunition available is 0% useful in a moment of need but 100% safe. It is axiomatic that as gun safety technology gradually implements systems and devices for rendering a hand gun more readily useful in a given situation, the degree of safety of the gun in that situation decreases in proportion to the increased degree of utility. Thus, the principal problem facing hand gun safety specialists is to develop and apply technology directed toward generating an optimal relationship of improved gun safety and effective gun utility.

Firearm safety devices have long been well known, having evolved for over a century from simple mechanical trigger obstructions to rather sophisticated built-in firing mechanism locking devices, as well as to external devices designed to be attached to a hand gun, preventing it from being operated in an unintended manner. In this latter category, to which the present invention relates, various types of gun safety devices have been designed and developed, and the prior art is replete with examples which have served the purpose of safety to one degree or another, but have in return hampered the utility of the gun by an authorized user. Despite the commercial availability of gun safety devices, they are not generally utilized by those individuals who obtain a hand gun for protection because they impede instant use of the gun and therefore detract from the high degree of utility which owners require. Consequently, many accidental and unintentional woundings and deaths continue to occur throughout the United States because the current gun safety devices do not adequately address the aforementioned safety/utility relationship.

For example, one type of gun lock device commercially available attaches to the trigger guard of the gun and prevents manual access to the trigger. The degree of safety is relatively low for several reasons; the device is usually locked with a conventional tumbler lock which can be picked without great difficulty, the lock can be easily drilled out since there is no built in "fail-safe" feature, and the installation of such a device on a loaded gun could easily cause an accidental discharge. Also, the utility of a gun employing this type of device is greatly diminished because of the necessity for a hidden key and the concomitant activity of the user in finding the key, operating the lock, finding ammunition, loading the gun and responding to an emergency situation during times of extreme emotional stress.

Another type of gun lock device is a cable which is passed down the muzzle end of the barrel of the gun and out through the rear of the revolver barrel or the pistol firing chamber. The ends of the cable are then locked together with either a key or a combination lock. The key lock suffers from most of the drawbacks cited with the previous device, and in both cases the utility of the gun is significantly diminished.

Still another form of gun lock device is one of several types of dummy rounds which fit in a revolver cylinder, or a pistol firing chamber, and are either mechanically or explosively actuated to jam in the cylinder chamber or firing chamber if an attempt is made to operate the gun in the normal manner, thereby rendering the gun inoperable until an individual with significant gunsmith skills removes the jammed dummy round. Although this device can be installed on a loaded gun, thereby enhancing the utility aspect, it can generally be easily removed from the gun by an unauthorized person if he or she takes the trouble to examine the gun before firing it. Further, it is difficult to ensure safe operation since the activation of the dummy round depends upon the particular motions of the person using the weapon. Location of multiple dummy rounds in various firing positions would be required to ensure that a jamming action could occur. Further, at a time of high stress the legitimate operator may not be able to recall the particular sequence of the dummy round(s) and inadvertently jam his defensive protection when he or she is in most need of it.

One of the most common forms of gun lock devices to be found in the prior art is a rigid device which is inserted down the barrel of the gun and is locked therein by suitable means so that it cannot be removed except by an authorized person who knows how to unlock the device. Generally, these devices fall into one of two categories, one being a rod which extends through the barrel and into the revolver cylinder chamber or pistol firing chamber and which includes some way of locking the device to the muzzle end of the barrel, thereby preventing rotation of the revolver cylinder or operation of the pistol firing mechanism. The other category is the type of rod which connects to some form of dummy round in the revolver cylinder chamber or the pistol firing chamber, and which includes some form of locking device to prevent removal of the device from the gun barrel except by an authorized person. A significant advantage of this type of safety device is that it can be utilized on a loaded gun since the installation of the device does not involve the use of ammunition in either the operable firing chamber of the revolver or the firing chamber of the pistol, thereby enhancing the utility of the gun. However, the current design suffers from the disadvantages that it can easily be accidentally discharged during removal of the device from the gun, it may not work on existing guns, and the device can be removed from the gun by an unauthorized person, allowing the safety integrity of these devices to be defeated without great difficulty if one has common tools and skills, or can exert sufficient force to extract the rod from the barrel. Therefore, the major drawback of these devices at the present time is that while the degree of utility of the gun is enhanced, the degree of safety from accidental or inadvertent woundings is correspondingly low.

SUMMARY OF THE INVENTION

The gun lock device of the present invention obviates, and in many cases, eliminates the disadvantages of the prior art gun lock devices discussed above, yet retains the advantages thereof. As will be seen in detail hereinafter, the gun lock device of the present invention breaks the precedent of the aforementioned axiom regarding the inverse relationship of gun safety to gun utility, and for the first time provides a high degree of safety accompanied by a high degree of utility.

To this end, the gun lock device of the present invention, which is adapted for use with either a revolver or automatic pistol type hand gun for rendering the gun inoperable by an unauthorized person regardless of whether the gun is loaded or unloaded, comprises broadly a dummy round having the same general bullet-like configuration and dimensions of a round of live ammunition used in a particular gun, so that the dummy round fits within a cylinder chamber of a revolver or the firing chamber of a pistol. The device includes an elongate tube having an outside diameter slightly less than the calibre of the bore of the gun so that the tube is manually insertable into the muzzle end of the barrel of the gun, the tube extending from a point adjacent the inner end of the barrel outwardly beyond the muzzle end of the barrel. An elongate rod is mounted in the tube and extends from the inner end of the tube outwardly beyond the outer end of the tube. A gripping means is disposed on the inner end of the rod for alternately gripping and releasing the forward end of the dummy round. An actuating means is mounted on and interconnected between the outer end of the rod and the outer end of the tube for causing limited axial relative movement between the rod and the tube between a first position in which the gripping means is disposed within the tube for gripping the forward end of the dummy round and a second position in which the gripping means extends beyond the tube for releasing the forward end of the dummy round. Finally, there is a locking means operatively associated with the actuating means for alternately permitting and preventing operation of the actuating means, so that when the gripping means is gripping the dummy round and the actuating means is locked against operation, the locking device cannot be removed from the barrel of the gun, which is thereby rendered inoperable.

In some of its more specific aspects, the dummy round of the present invention is absolutely fail safe from the standpoint that if any attempt is made to defeat the high degree of security of the gun lock device by forcibly removing the assembly which is inserted down the barrel of the gun, the dummy round expands both axially and radially and thereby becomes so tightly wedged in the inner end of the gun barrel that it cannot be removed except with the use of tools typically utilized by gun gunsmiths. In addition, if sufficient force is applied, such as that beyond normal manual force, a portion of the dummy round is designed to break off and leave the remainder firmly wedged in the barrel of the gun, thereby permitting the assembly that is inserted down the gun barrel to be removed therefrom while still leaving the gun in a totally inoperable condition.

Means are provided whereby the device can be unlocked and removed from a gun solely by tactile perception, without the benefit of any visual perception, and in a manner which is entirely silent. In other words, the device can be unlocked and removed from a gun in the dark merely by the operator being able to "feel" certain parts that move relatively to each other and instinctively know when the device is unlocked, and this can be accomplished without any sound. Thus, one could keep his loaded gun in a night table drawer with the gun lock device installed and, should the need arise, remove the gun from the drawer and unlock and remove the gun lock device entirely in the dark and without making any sound.

A significant feature of the invention is that it is ergonomically designed to eliminate the possibility of the owner accidentally discharging the gun while either installing or removing the gun lock device. This is achieved by providing an unlocking and locking procedure which requires the operator to use both hands to hold the gun and operate the locking mechanism, thereby preventing the operator's hands from coming in contact with the trigger.

A uniquely advantageous feature of the present invention resides in the adaptability of the aforementioned locking means to function in a locking device having utility independent and apart from the primary purpose of the locking device of the present invention, that is, in any form of locking device which performs its intended purpose through movement of a mechanical element.

Having thus briefly described the general nature of the present invention, it is a principal object thereof to provide a high security gun lock device which avoids or eliminates the disadvantages of prior art gun lock device and provides advantageous features not heretofore known.

Another object of the present invention is to provide a high security gun lock device which is absolutely fail safe in the sense that any attempt to defeat the security of the device results in the gun being rendered completely useless without the aid of specialized tools and skills, while at the same time retaining a high degree of utility.

A further object of the present invention is to provide a gun lock device which can be operated entirely by tactile perception, without the aid of visual perception, and which can be so operated without the gun lock device emitting any sound, so that the gun lock device can be unlocked and removed from the gun in the dark and without any audible warning that this is being accomplished.

A still further object of the present invention is provide a gun lock device in which the locking means thereof has independent utility which renders it operable in any form of locking device capable of performing its intended function through a simple mechanical movement.

Other significant objects of the present invention are to provide a gun lock device which can be removed very quickly and easily, can be used with all sizes of hand guns, requires no modification of the gun and is economical to obtain and maintain.

These and other objects and advantages of the present invention will be more apparent from an understanding of the following detailed description of a presently preferred embodiment of the invention, when considered in conjunction with the accompanying drawings which show details of the invention as described below.

DETAILED DESCRIPTION OF THE INVENTION

Figure 1:
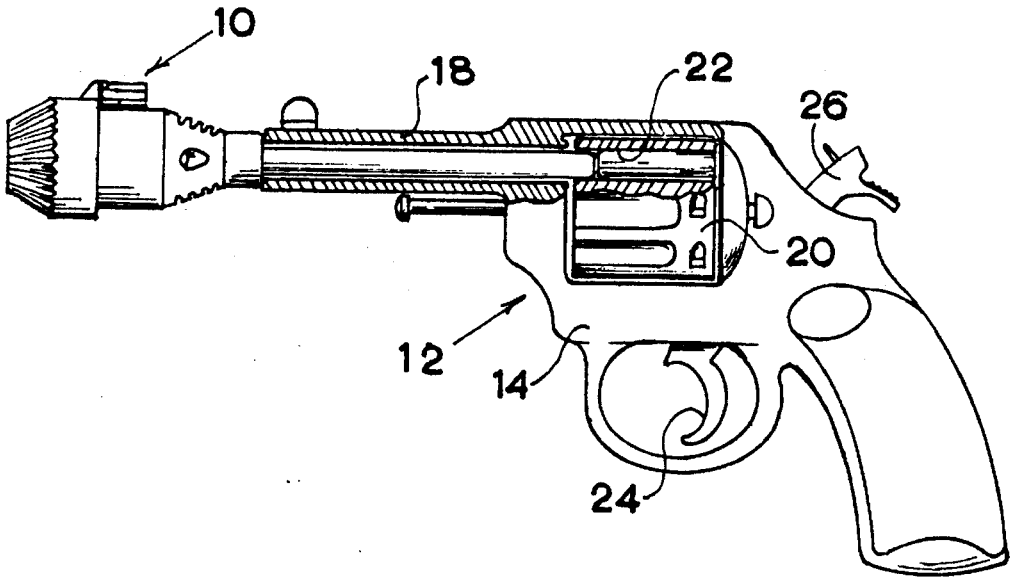
FIG. 1 is a side, partially section, view of a common form of revolver showing the gun lock device of the present invention installed therein.
Figure 2:
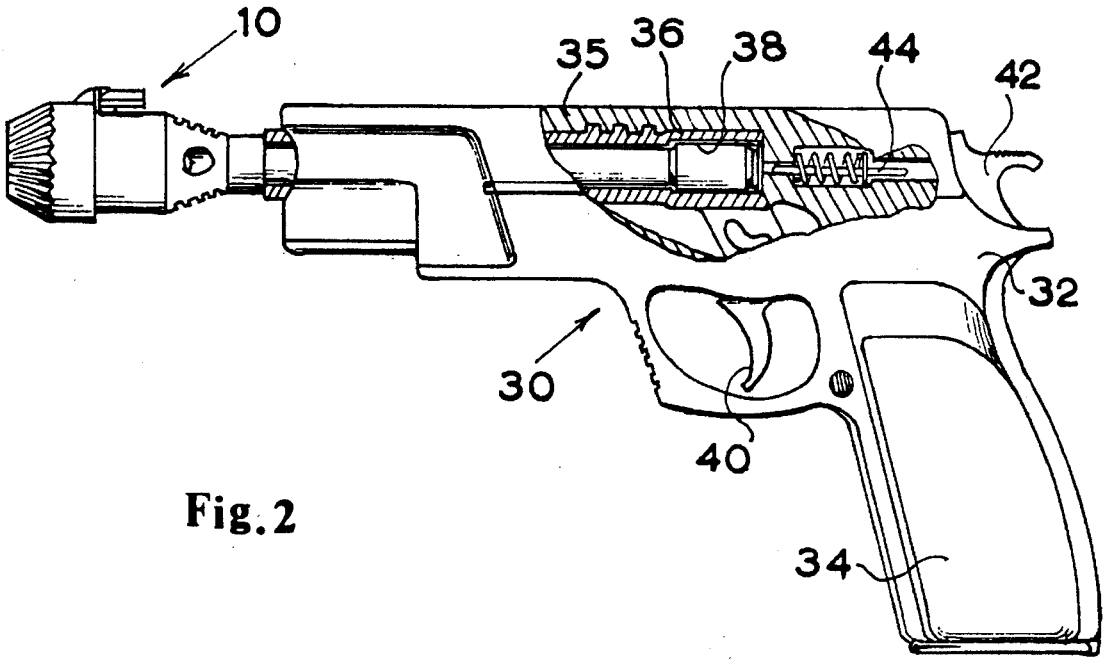
FIG. 2 is a view similar to FIG. 1 showing a common form of automatic pistol showing the gun lock device of the present invention installed therein.

Referring now to the drawings and particularly to FIGS. 1 and 2 thereof, the reference numeral 10 designates generally the gun lock device of the present invention. In FIG. 1, the gun lock device is shown installed in a typical revolver type hand gun, designated generally by the reference numeral 12. As is generally known, a common form of revolver 12 comprises a frame 14, a handgrip 16 connected to the frame 14, a barrel 18 connected to the forward end of the body 14, and a cylinder 20 rotatably mounted in the frame 14. The cylinder is provided with a plurality of chambers 22 for holding rounds of ammunition (not seen in FIG. 1). A trigger 24 is connected to a firing mechanism (not shown) which operates a hammer 26 and causes it to strike the rear end of a round of ammunition held in the cylinder chamber which is in line with the barrel 18, causing the bullet portion of the round to be fired from the barrel 18. In a double acting revolver, operation of the firing mechanism also causes the cylinder 20 to rotate a predetermined amount to bring the next chamber 22 into alignment with the barrel 18 so that the gun is ready to be fired merely by further pressure on the trigger.

In FIG. 2, the gun lock device 10 is shown installed in a typical automatic pistol type hand gun, designated generally by the reference numeral 30. Again as is generally known, the pistol 30 comprises a main frame 32, a hand grip 34 connected to the main frame 32 and containing a magazine for ammunition, an upper frame 35 mounted on the main frame 32 for axial movement with respect thereto. A barrel 36 is held between the main frame 32 and the upper frame 35, and contains the firing chamber 38 adjacent the rear end thereof. A trigger 40 is connected to a firing mechanism (not shown) which operates a hammer 42 and causes it to strike a firing pin 44 located in the rear portion of the upper frame 35 which in turn strikes the rear end of a round of ammunition held in the firing chamber 38, causing the bullet portion of the round to be fired from the barrel 36. High pressure gas from the burning of the gun powder forces the upper frame 35 rearwardly in order to eject the spent cartridge from the firing chamber by an ejecting mechanism, thereby allowing a fresh round of ammunition held in the magazine to be inserted into the firing chamber 38 as the upper frame 35 returns to its normal position. Thus, the gun is ready to be fired immediately after each previous round is discharged.

Figure 3:
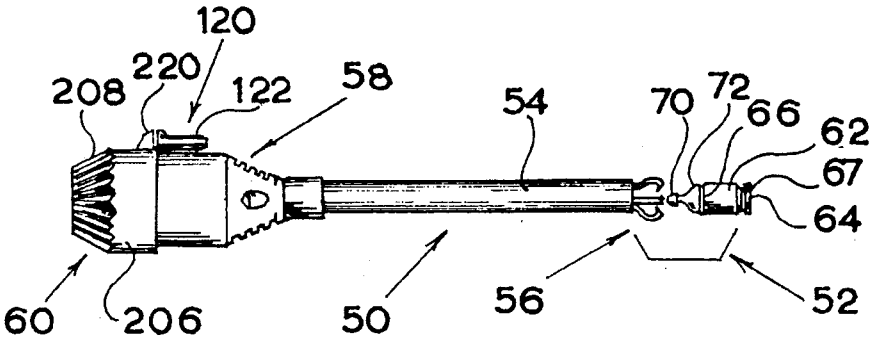
FIG. 3 is a side view of the gun lock device of the present invention showing the major sub-assemblies of the device as they would appear when not installed in a gun.

As best seen in FIG. 3, the gun lock device 10 of the present invention comprises two major components, a gripping and locking assembly designated generally by the reference numeral 50 and a dummy round assembly designated generally by the reference numeral 52. The gripping and locking assembly 50 comprises a hollow tube 54 adapted to be inserted into the muzzle end of the barrels 18 or 36 of the revolver 12 or pistol 30 respectively. A gripping means, designated generally by the reference numeral 56, is mounted on a rod (not seen in FIG. 3) which extends through the tube for gripping the forward end of the dummy round 52 in a manner fully described hereinafter. An actuating mechanism (not seen in FIG. 3) is located within a housing, designated generally by the reference numeral 58, for operating the gripping means 56 to alternately grip and release the forward end of the dummy round 52. Finally, a locking means (not seen in FIG. 3) for the actuating mechanism is located with a forward portion of the housing 58 adjacent to an operating knob, generally designated generally by the reference numeral 60, by which the locking means is operated to alternately prevent and permit operation of the actuating mechanism. The foregoing features of the gripping and locking assembly not seen in FIG. 3 will be fully shown and described hereinafter.

As seen in the right end of FIG. 3, the dummy round 52 has the same general configuration and dimensions of a round of live ammunition used with the particular gun with which the gun lock device is intended for use so that the dummy round 52 fits within the cylinder chamber 22 of the revolver 12 or the firing chamber 38 of the pistol 30 in the same manner as a round of live ammunition. The dummy round 52 comprises a cylindrical casing 62 having a base 64 and a forward rim 66. A bullet 68 is partly confined within the casing 62 and has a bulbous head 70 which defined by a reduced neck 72 adjacent the forward end of the bullet 68.

Figure 4:
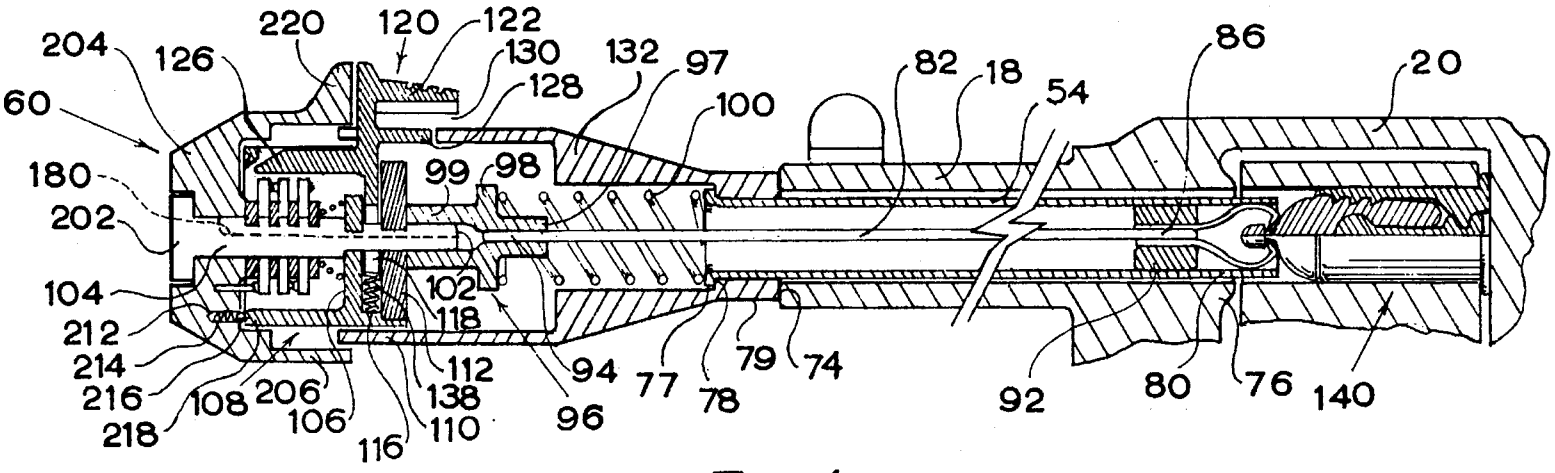
FIG. 4 is a longitudinal sectional view of the entire gun lock device installed in the revolver shown in FIG. 1, with the parts shown in the positions they occupy when the device is in a fully locked condition.

Referring now to FIG. 4, it will be seen that the gun lock device 10 is installed in the revolver 12; however, the following description of both the construction and operation of the gun lock device 10 would be the same as if the device were installed in the pistol 30. As stated above, the gun lock device 10 comprises the hollow tube 54 which has an outside diameter slightly less than the calibre of the bore of the revolver 18 so that the tube 54 is manually insertable into the muzzle end 74 of the barrel 18. The tube 54 extends from a point adjacent the inner end 76 of the barrel 18 outwardly beyond the muzzle end 74 thereof and terminates in a radially outwardly projecting flange 77 which bears against a shoulder 79 formed inside the housing 58 adjacent the inner end thereof. The inner end 80 of the tube 54 is also adjacent the forward end of the dummy round 52 when it is positioned in the cylinder chamber 22 of the revolver 12 or the firing chamber 38 of the pistol 30. Thus, the diameter and length of the tube 54 will vary with the type, calibre and size of the gun with which it is intended for use; however, adapters can be provided to ensure that the inner end of the housing 58 fits snugly against the muzzle end of the barrel 18.

An elongate rod 82 is mounted in the tube 54 and extends from a point adjacent the inner end 80 of the tube 54 outwardly beyond the outer end flange 77 of the tube 54. The gripping means 56 comprises a plurality of gripping hooks 84 which are mounted adjacent the inner end 86 of the rod 82 for alternately gripping and releasing the bulbous head 70 of the dummy round 52 as fully described hereinafter. The gripping hooks 84 each have an outwardly curved spring arm 88 which terminates in a reverse direction hook portion 90. The construction and arrangement of the spring arms 88 is such that the gripping hooks are normally biased radially outwardly away from the actuating rod 82 when the gripping hooks are extended beyond the inner end 80 of the tube 54 and are pressed inwardly toward the rod 82 by the inner surface of the tube 54 when the gripping hooks 84 are confined within the inner end 80 of the tube 54 in response to operation of an actuating mechanism to be described hereinafter. A sleeve 92 is mounted inside the tube 54 adjacent the inner end 80 thereof. The sleeve 92 performs two functions; it supports the inner end portion of the rod 82 to ensure that both the inner end portion of the actuating rod 82 and the gripping hooks 84 are centered in the tube 54. Also, by utilizing sleeves 92 of different diameter, it is possible to use the same size gripping hooks 84 and bulbous head 70 on the dummy round 52 regardless of the calibre of the gun with which the gun lock device 10 is used.

The aforementioned actuating mechanism is mounted on the outer end 94 of the rod 82 and includes and is partly enclosed within the housing 58. The actuating mechanism further comprises a coupler designated generally by the numeral 96 suitably connected at its inner end 97 to the outer end 94 of the rod 82, the coupler 96 having radial flange 98 located at about the center of the coupler 96 which serves as an abutment for a compression spring 100 which is captured between the flange 77 formed on the outer end of the tube 54 and the flange 98 on the coupler 96. The spring 100 normally biases the rod 82 outwardly with respect to the tube 54 which thereby normally maintains the gripping hooks 84 within the inner end 80 of the tube 54. The outer end 99 of the coupler 96 is connected to the inner end 102 of a lock pin 104 which is fixedly connected to an intermediate wall 106 of a cylindrical lock cage designated generally by the numeral 108 by means of a key 105 which fits into a slot 107 formed in a reduced diameter portion 109 of the lock pin 104, thereby locking the lock pin 104 and the lock cage 108 together. The lock cage 108, which is part of a lock mechanism yet to be described, is mounted within the forward portion 110 of the housing 58, and further includes a rear wall 112 against which the outer end 99 of the sleeve 96 bears. The intermediate wall 106 and the rear wall 112 define therebetween a space or channel 116 which receives the legs 118 of an interposer designated generally by the reference numeral 120.

Figure 5:
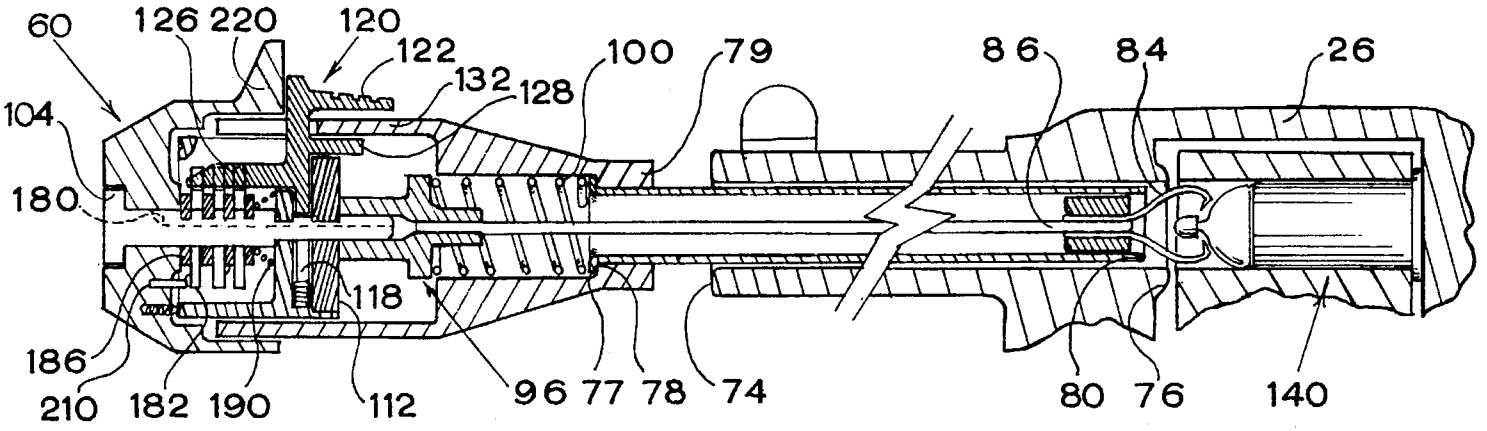
FIG. 5 is a view similar to FIG. 4, but showing the parts in the positions they occupy when the device is in an unlocked condition, but still installed in the gun.
Figure 6:
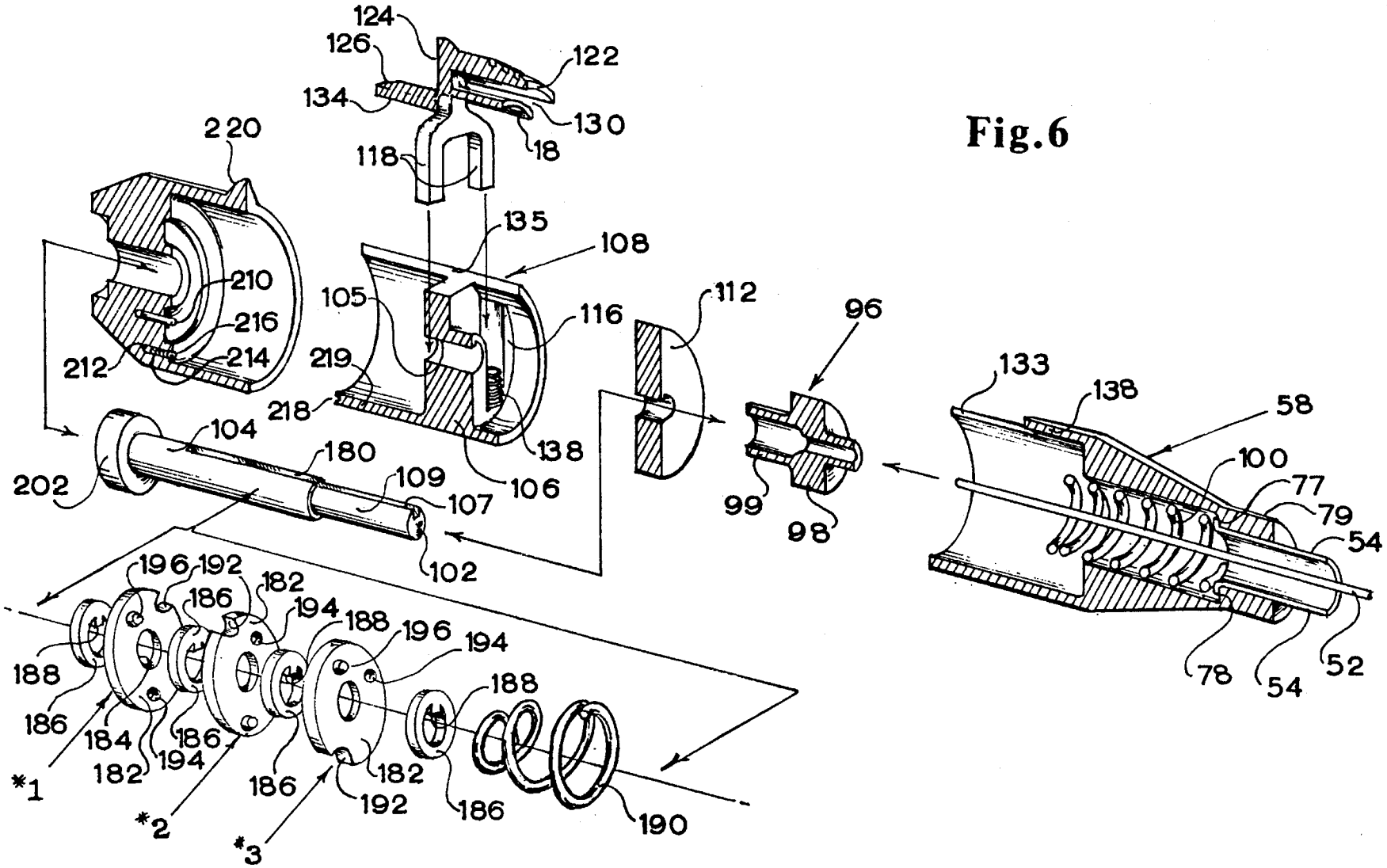
FIG. 6 is a perspective, exploded, partially sectional view of the parts of the actuating mechanism and locking mechanism of the gun lock device.

As best seen in FIG. 6, the interposer 120, which forms part of the aforementioned locking mechanism, comprises a serrated finger button 122 disposed on the upper end of an upstanding wall 124, which is joined with an elongate body member 126 extending in opposite directions from the upstanding wall 124. The finger button 122 and the inner portion 128 of the body member 126 define therebetween a space 130 which is adapted to receive an upper forward wall portion 132 of the housing 58 behind a slot 133, as best seen in FIGS. 5 and 6, when the interposer 120 is depressed to allow the housing 58 to be moved in a forward direction to cause the gripping hooks 84 to release the bulbous head 70 of the dummy round 52, which operation will be described in more detail hereinafter. The interposer 120 also includes a rib 134 extending along the underside of the body member 126 which interacts with the locking mechanism in the manner described below. The lock cage 108 also includes a wide slot 135 along the upper portion thereof through which the body member 126 of the interposer 120 passes when the interposer 120 is depressed. The interposer 120 is normally biased upwardly by a pair of compression springs 136 captured between the underside of the legs 118 and the bottom of the lock cage 108, in which position the forward end of the inner portion 128 of the body member 126 abuts the outer end of the upper forward wall portion 132 of the housing 58, thereby preventing movement thereof.

From the structure thus far described, it will be seen from a comparison of FIGS. 4 and 5, that when the interposer 120 is in the raised position shown in FIG. 4, the housing 58 is disposed in a rearward position relative to the lock cage 108, and the rear wall 79 of the housing 58 abuts the muzzle end the barrel 18. In this position, the tube 54 is in a first position in which the gripping hooks 84 are disposed within the inner end 80 of the tube 54 and are gripping the bulbous head 70 of the bullet 68, as seen in FIG. 4. With the parts in this position, the gripping and locking assembly 50 is rigidly connected to the dummy round assembly 52, thereby effectively preventing the revolver cylinder 20 from rotating and the dummy round 52 from being ejected from the firing chamber 38 of the pistol 30. Thus, both the revolver 12 and the pistol 30 are rendered completely inoperable. However, when the interposer 120 is depressed to the position shown in FIG. 5, the housing 58 can then be moved forwardly relative to the lock cage 108, since the upper forward wall portion 132 can be received in the space 130 between the underside of the finger button 122 and the upper surface of the forward portion 128 of the body member 126. When the housing 58 is moved to this position, it pulls the tube 54 forwardly due to the interconnection between the flange 77 on the outer end of the tube 54 and the shoulder 78 on the inner end of the housing 58. In this position, the tube 54 is in a second position in which the gripping hooks 84 are disposed rearwardly beyond the inner end 80 of the tube 54, thereby allowing the spring fingers 88 of the gripping hooks 84 to move the hook portions 90 outwardly so as to release the bulbous head 70 of the bullet 68, as seen in FIGS. 5. This allows the gripping and locking assembly 50 to be removed from the barrel 18 of the gun so that the revolver cylinder 20 can rotate and the dummy round 52 can be ejected from the pistol firing chamber 38, thereby rendering the respective guns operable. This operation will be considered again hereinafter in connection with a description of the overall operation of the invention.

It should be understood that the gun lock device of the present invention is fully operable with a dummy round assembly 52 configured in the manner of a conventional round of live ammunition. In other words, the dummy round 52 need only be a bullet 68 fixedly mounted in a casing 62, but with a bulbous head 70 on the forward end of the bullet, substantially as shown in FIG. 3. However, a principal feature of the present invention resides in the provision of an enhanced dummy round assembly in which a bullet is movably mounted in a casing so that it can be partially extracted therefrom by forcible outward movement of the gripping and locking assembly 50 while it is still attached to the bullet. The purpose of this feature is to render the gun lock device 10 fail safe in that if any attempt is made to forcibly remove the gripping and locking assembly 50 from the gun without properly unlocking it and operating the actuating mechanism to separate it from the dummy round assembly, the bullet is partially extracted from the casing in a manner which radially expands it so that it becomes wedged very tightly in a position in which the bullet is disposed partly in the revolver cylinder chamber or the pistol firing chamber, as the case may be, and partly in the barrel of the respective guns, and cannot thereafter be removed except with tools and procedures such as those employed by a gunsmith.

Figure 7:
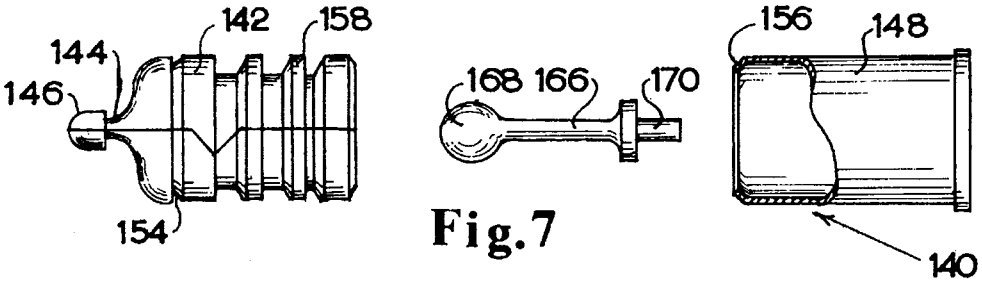
FIG. 7 is a side view of the enhanced dummy round assembly, showing the bullet and the expanding rod removed from the casing to reveal detail.
Figure 8:
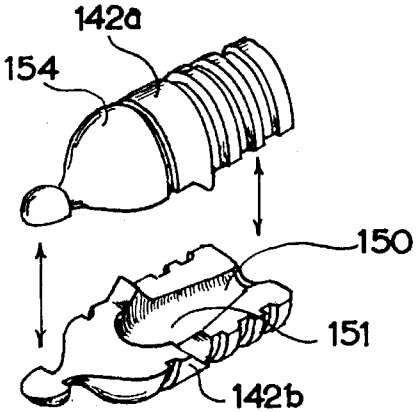
FIG. 8 is a perspective view of the two halves of the bullet portion of the dummy round shown in FIG. 9.

Thus, with reference to FIGS. 7 through 11, the enhanced dummy round assembly, designated generally by the reference numeral 140 in FIG. 7, comprises a bullet 142 having a reduced neck 144 adjacent the forward end thereof which defines a bulbous head 146, all substantially the same as the dummy round 52 shown in FIG. 3. However, the bullet 142 is formed of two half sections, **142*a* and 142*b*, as seen in FIG. 8, which are adapted to fit together when assembled in the casing 148 shown in FIG. 7. As best seen in FIG. 8, each half of the bullet 142 is provided with a channel 150 extending forwardly from the rear end of the bullet and terminating in an enlarged half sphere 151, so that when the two halves 142*a* and 142*b* of the bullet 142 are assembled together, the channels 150 form an elongate bore 152 and the half sphere portions 151 form an enlarged chamber 153 at the forward end of the bore 150 (see FIG. 9). The bullet 142 also has an annular recess 154 which is adapted to receive an inwardly bent rim 156 formed on the forward end of the casing 148 when the bullet 142 is fully inserted into the casing 148. The bullet 142 is also provided with a plurality of wedge shaped serrations 158 formed along the rear half of the bullet 142 which are adapted to be engaged sequentially by the inwardly bent rim 156 of the casing 148** as the bullet is extracted from the casing.

Figure 9:
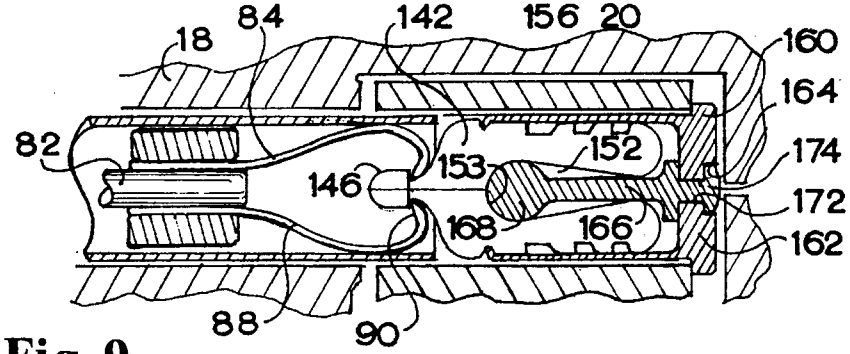
FIG. 9 is an enlarged, sectional view of the enhanced dummy round installed in a revolver cylinder chamber with the gripping means attached to the head portion of the bullet with the gun lock device in its normal locked condition.

As best seen in FIG. 9, the rear end portion 160 of the easing 148 is provided with a base 162 which is somewhat depressed into the casing 148 to provide a recess 164 opening toward the rear end of the casing. An expansion rod 166 having an enlarged head 168 formed on the forward end thereof is rigidly connected to the base 162 by means of a stub shaft 170 which passes through an aperture 172 in the rear wall 162, the outer end of the stub shaft 170 being rolled over in the manner of a rivet to form the retaining head 174. The head 174 is disposed in the recess 164 to ensure that it does not interfere either with rotation of the of the cylinder 20 of the revolver 12 or operation of the ejecting mechanism of the pistol 30.

Figure 10:
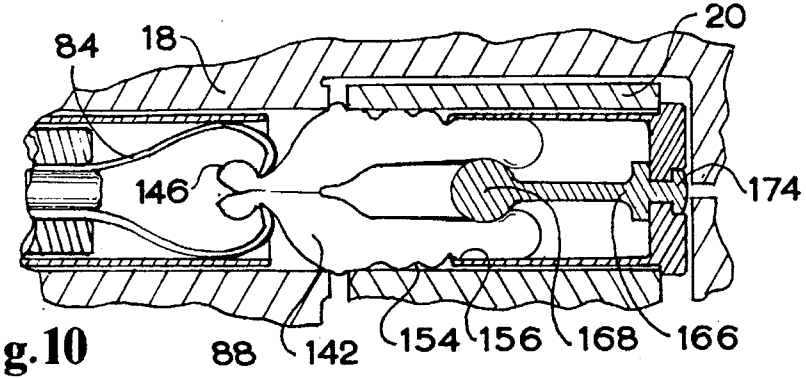
FIG. 10 is a view similar to FIG. 9, but showing the bullet portion of the dummy round partially extracted from the casing and also radially expanded so as to be firmly wedged in the barrel of the gun in response to a pulling force on the gripping and locking portion of the gun lock device in an attempt to remove it from the gun.

From the foregoing construction, and by comparing FIGS. 9 and 10, it will be seen that an excessive outward pulling force exerted on the gripping and locking assembly 50, without the gripping hooks 84 having been disengaged from the bulbous head 146 of the bullet 142, will cause the bullet 142 to move outwardly with respect to the casing 148. However, due to the retaining head 174 bearing on the base 162 of the casing 148, the expansion rod 166 cannot move, as a result of which the enlarged head 168 on the expansion rod 166 enters the bore 152, thereby forcing the two halves **142*a* and 142*b* of the bullet apart. This radial expansion of the bullet 142 produces two results; one is that as the bullet moves forwardly from the position shown in FIG. 9 to that shown in FIG. 10, the inwardly bent rim 156 on the forward end of the casing 148 enters one of the wedge shaped depressions 158 on the outer surface of the bullet 142, depending on how far the bullet 142 is moved forwardly, thereby preventing any reverse movement of the bullet 142 and positively locking it in the partially extracted position. Also, radial expansion of the bullet 142 causes the surrounding casing 148 to be firmly wedged in the cylinder chamber 22 or the firing chamber 38 of the revolver 12 or pistol 30. The combined action of the partial extraction of the bullet 142 from the casing 148 and the radial expansion of the bullet 142 and the casing 148 renders the gun not only inoperable but also totally useless to anyone, particularly a gun thief, since the bullet 142** must now be removed by an experienced gunsmith in order to render it operable.

Figure 11:
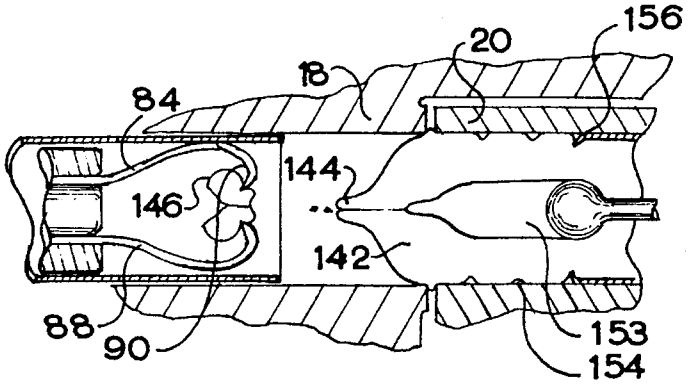
FIG. 11 is a view similar to FIGS. 9 and 10, but showing the head portion of the bullet severed from the main body portion as a result of an excessive pulling force applied to the gripping and locking portion of the gun lock device.

There is a still further safety feature to the enhanced dummy round 140, which is illustrated in FIG. 11. In the event that an unauthorized person attempts to exert such excessive outward pulling force on the gripping and locking assembly 50 as to attempt to pull the enhanced dummy round 140 out of the gun, casing and all, the reduced neck 144 of the bullet 142 is designed to break and sever the bulbous head 146 from the rest of the bullet 142 before the stub shaft 170 breaks. This allows the gripping and locking assembly 50 to be removed from the barrel 18 of the gun and leave the enhanced dummy round 140 wedged in the gun in the manner described above. Thus, it will be appreciated that the features of the enhanced dummy round 140 render the gun lock device 10 totally fail safe against any attempt to defeat the high security thereof.

As briefly stated in the Summary of the Invention, the gun lock device of the present invention is provided with a locking means which affords the user certain advantageous features not found in prior art gun lock devices. In particular, the gun lock device can be removed from the gun on which it is installed entirely in the dark and without any audible signal that it is being removed because the unlocking operation is performed solely by tactile perception, without the benfit of any visual perception. In addition, the locking means has independent utility apart from the purpose for which it was intended in the gun lock device of the present invention in that it can be used in any form of locking device in which a simple mechanical movement suffices to lock the particular device. These features will be more apparent from the following discussion.

Although a variety of combination lock mechanisms could be utilized without departing from the spirit and scope of the present invention, the preferred embodiment disclosed herein includes a plurality of tumbler elements which are manually settable to predetermined positions in which the interposer 120 can be moved to its depressed position as described above. Thus, with reference to FIGS. 4, 5 and 6, it will be seen that the lock pin 104, which, as was previously stated, is fixedly connected to an intermediate wall 106 of the lock cage 108 at the reduced shoulder 105, has an elongate slot 180 in the uppermost portion thereof which extends along the wider diameter portion of the lock pin 104. A plurality of lock tumblers 182, in the form of disks having central apertures 184, are mounted on the wider diameter portion of the lock pin 104 and are freely rotatable thereon. The tumblers 182 are separated from each other by a plurality of friction washers 186 which are interposed between the tumblers 182 and are also disposed at either end of the row of lock tumblers 182. Each friction washer 186 is provided with a tab 188 which fits into the slot 180 formed in the lock pin 104, thereby keying each friction washer to the lock pin 104 to prevent rotation thereof with respect to the lock pin 104. The tumblers 182 and the friction washers 186 are maintained in relatively tight frictional engagement by a compression spring 190 which is captured between the intermediate wall 106 of the lock cage 108 and the innermost of the friction washers 186. Thus, once a tumbler is moved to a certain angular position in the manner described below, it remains in that position notwithstanding rotary movement of the other tumblers. Although as many tumblers 182 as desired may be provided, the number depending on the desired comlexity of operation of the combination lock mechanism, the preferred form of the invention includes three tumblers 182 with four friction washers 184 mounted on the lock pin 104.

Each tumbler 182 is provided with a radially outwardly opening slot 192 at some point around its circumference, the purpose of which is to receive the rib 134 on the underside of the body member 126 of the interposer 120 when the slots 192 of the three tumblers are brought into axial alignment in the manner fully described below. Each tumbler 182 is also provided with a pair of small projections 194 and 196 which face forwardly and rearwardly respectively. The location of the slot 192 and the projections 194 and 196 are different for each tumbler 182 in order to establish a unique pattern for operating each individual lock mechanism. For example, as best seen in FIG. 6, the outermost lock tumbler 182, labeled #1, has the slot 192 at about the 1:00 o'clock position, the forward facing projection 194 at the 6:00 o'clock position and the rearwardly facing projection 196 at about the 11:00 o'clock position. The next lock tumbler 182, labeled #2, has the slot 192 at about the 12:00 o'clock position, the forwardly facing projection 194 at about the 2:00 o'clock position and the rearwardly facing projection 196 at about the 7:00 o'clock position. The innermost lock tumbler 182, labeled #3, has the slot 192 at about the 7:00 o'clock position, with the forwardly facing projection 194 at the 3:00 o'clock position and the rearwardly facing projection 196 at about the 11:00 o'clock position. It should be understood that the foregoing arrangement is entirely arbitrary and can be varied almost indefinitely so that no two gun lock devices can be operated identically to unlock them. If desired, the slots 192 for any two or all three of the tumblers 162 could be the same in order to include combinations of 111, 11-, 1-1 and -11 through 999, 99-, 9-9 and -99.

Means are provided for rotating the tumblers 182 from the random positions shown in FIG. 6 to a position in which the slots 192 of all of the tumblers 182 are axially aligned in an uppermost position so as to receive the rib 134 on the interposer 120. As best seen in FIGS. 4, 5 and 6, this is accomplished by manual rotation of the operating knob 60 which is rotatably mounted on the lock pin 104 and is held thereon by the enlarged head 202. The knob 60 is generally cup shaped with an outermost head portion 204 and in inwardly opening cylindrical portion 206 which surrounds the lock cage 108. The knob 60 has a tapered knurled surface 208 adjacent its outer end by which the knob is grasped for rotating it.

The inner wall of the head portion 204 is provided with a rearwardly facing projection 210 which is similar to the projections 194 and 196 on opposite faces of the tumblers 182. The head portion 202 of the knob 60 is also provided with a plurality of bores 212, each of which contains a small compression spring 214 which presses against a ball 216 captured within the bore 212 in known manner. The balls 216 cooperate with a plurality of detents 216 formed in the outer circular face 219 of the lock cage 108, so that as the knob 60 is rotated relative to the lock cage 108, the balls 216 and detents 218 provide a plurality of click stops for the knob 60. The construction of the ball and detent arrangement is such that an operator turning the knob 60 can "feel" the balls 216 enter the detents 216; that is, there is sufficient change in the degree of resistance to movement of the knob 60 that the operator knows by tactile perception that the knob has reached one of the click stops, yet the action of the balls entering the detents is virtually silent, at least to normal hearing. Thus, the ball and detent construction provides a virtually silent means for determining digital rotary movement of the knob 60 in increments of less than one full revolution. Finally, the knob 60 also includes a raised projection 220 formed on the outer surface thereof which can be felt by a user of the gun lock device in order to ascertain when the projection 220 and the finger button 122 of the interposer 120 are in alignment. This construction allows the operator to ascertain by tactile perception when the knob 60 has moved through one complete revolution.

The overall operation of the gun lock device 10 will now be described, commencing with preparation of the device for installation on a revolver or pistol as shown in FIGS. 1 and 2. Initially, it is necessary to install either the dummy round 52 or the enhanced dummy round 140 in either an empty chamber 22 in the cylinder 20 of the revolver 12 or the firing chamber 38 of the pistol 30. In the former case, the cylinder 20 is opened in the usual manner and a round of live ammunition is replaced with either type of dummy round and the cylinder is closed with the dummy round aligned with the barrel 18. With the pistol, the magazine is removed from the handgrip 34 and a dummy round is inserted in the top position in the magazine. The magazine is then replaced in the hand grip and the pistol is cocked in the normal manner, thereby inserting the dummy round into the firing chamber 38. The gun is now ready to receive the gripping and locking assembly 50.

Assuming that the tumblers 182 are in the angular position in which the slots 192 in all of the tumblers are in alignment in the uppermost position, the gripping and locking assembly 50 is inserted into the barrels 18 or 36 until the gripping hooks 84 abut the bulbous head 70 of the dummy round 52 or the bulbous head 146 of the enhanced dummy round 140. The interposer 120 can now be depressed against the action of the springs 138 to the position shown in FIG. 5 because the rib 134 will enter the slots 192. In this position, the forward end 128 of the body member 126 does not obstruct outward movement of the upper forward wall portion 132 adjacent the slot 133 of the housing 58. The housing 58 and the knob 60 are pushed toward each with the result that the housing 58 moves outwardly with respect to the barrels 18 or 36 against the force of the spring 100. Outward movement of the housing 58 moves the tube 54 in the same direction because of the cooperative action of the flange 77 on the outer end of the tube 54 and the shoulder 78 adjacent the inner end 79 of the housing 58. The rod 62 is fixed relative to the knob 60, since it is connected through the sleeve 96 to the lock pin 104 which is fixed to the knob 60. Therefore, when the housing 58 and tube 54 move outwardly, the rod 82 remains stationary when the tube 54 moves outwardly, thereby drawing the inner end 80 of the tube 54 beyond the outermost portion of the curved spring arms 88 of the gripping hooks 84. This allows the spring arms 86 to move radially outwardly so that the hook portions 90 of the gripping hooks 64 can pass over the bulbous head 70 of the dummy round 52 or 146 of the enhanced dummy round 140 in response to further inward movement of the entire gripping and locking assembly 50, thereby placing the hook portions 90 in the innermost position as shown in FIG. 5. With the parts in this position, the operator allows the spring 100 to move the housing 56 inwardly relative to the barrels 16 or 36, thereby moving the tube 54 and the rod 62 relative to each other so that the inner end of the tube 54 moves over the outermost portion of the curved spring fingers 66 of the gripping hooks 84 so that the hook portions 90 move radially inwardly to the position shown in FIG. 4, thereby firmly gripping the bulbous head 70 or 146 to prevent removal of the gripping and locking assembly 50 from the barrel 18 or 36.

When the housing 58 reaches the innermost position under the force of the spring 100, the upper forward wall portion 132 of the housing 58 clears the upper surface of the forward portion 128 of the body member 126 so that the upper forward wall portion 132 is aligned with the space 130 between the forward portion 128 and the underside of the finger button 122, thereby allowing the interposer 120 to move upwardly under the force of the springs 138 to the position shown in FIG. 4. When the interposer 120 moves to this position, the rib 134 is withdrawn from the slots 192 in the tumblers 182 so that the tumblers can be rotated by the knob 60 to other positions in which the slots 192 are not aligned, thereby preventing downward movement of the interposer 120 and effectively locking the gripping and locking assembly 50 in the barrel 18 or 36.

In order to unlock the gripping and locking assembly 50 for removal from the barrel 18 or 36, it is necessary to again rotate the tumblers 182 so as to align the slots 192 to receive the rib 134 on the interposer 120. Two of the unique features of the gun lock device 10 becomes apparent in connection with performing the following sequence of movements. First, with reference to FIG. 12, and assuming for the purpose of explanation that the operator is right handed, he would normally grasp the gun with the barrel 18 or the upper frame 37, depending on the type of gun involved (the pistol 30 being shown in FIG. 12), and the housing 58 of the gun lock device 10 in his left hand, but with his thumb resting on both the finger button 122 and the projection 220 on the upper inner surface 206 of the knob 60. The operator grasps the knurled surface 208 of the knob 60 with his right hand in order to rotate the knob 60 to operate the locking mechanism. It is immediately apparent from the position of the operator's hands in FIG. 12 that the gun lock device 10 is ergonomically designed to be operated in a manner which makes it virtually impossible for the operator to accidentally contact the trigger 40 during the unlocking procedure described below, thereby rendering the gun lock device absolutely safe, even when operated in the dark in the manner described below.

Figure 12:
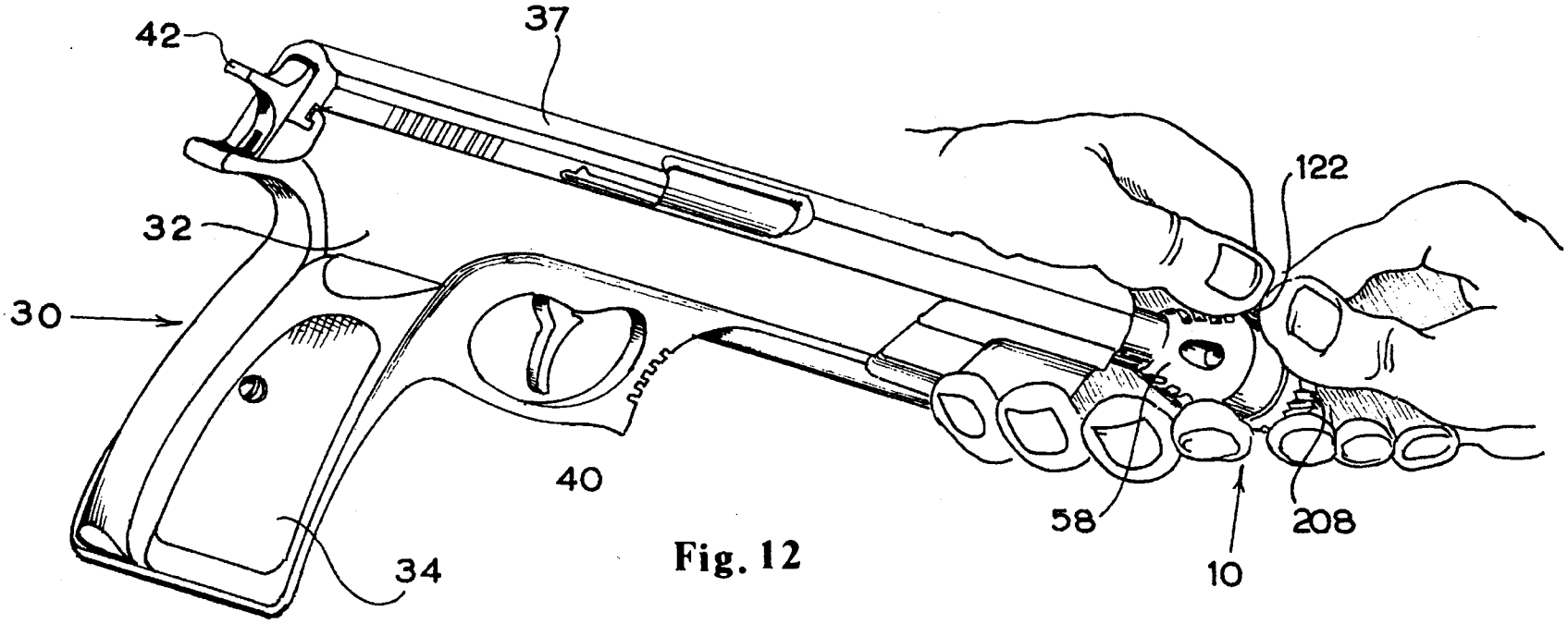
FIG. 12 is a perspective view of an operator holding a gun in the recommended position for inserting the gun lock device of the present invention.

Again looking at FIG. 12, after the gun and the gun lock device have been grasped in the recommended manner, the operator rotates the knob 60 in a clockwise direction relative to the housing 58, turning the knob 60 through three full revolutions. At this point, another unique feature of the invention becomes apparent in that, although this operation can obviously be performed in full view of the operator, it can also be performed in the dark due to the tactile perception from the projection 220 each time the projection 220 passes adjacent the finger button 122 which, for ease of further explanation, will be hereafter referred to as the "0" position, since each full revolution of the knob 60 causes the projection 220 to pass under the operator's right thumb, which he can feel. The reason for the initial three revolutions of the knob 60 is to cause the inwardly facing projection 210 on the inner wall of the lock cage 108 to engage the outwardly facing projection 194 on the #1 tumbler 182, thereby rotating this tumbler, and thereafter to cause the inwardly facing projections 196 on the #1 and #2 tumblers 182 to engage the outwardly facing projections 194 on the #2 and #3 tumblers 182 respectively, thereby rotating these lock tumblers, so that all of the projections 210, 194 and 196 are in contact with each other. The combination lock mechanism is now ready to be operated to an unlocked condition.

Commencing with the parts in these positions, further clockwise rotation of the knob 60 past the 0 position by a first predetermined number of clicks will bring the slot 192 on the #3 tumbler to the uppermost position. The knob 60 is now rotated in a counterclockwise direction two full revolutions, as indicated by tactile perception of the projection 220, plus a second predetermined number of click stops past the 0 position. After the first complete revolution, the inwardly facing projection 210 on the knob 60 has moved to the opposite side of the outwardly facing projection 194 on the #1 tumbler and can now rotate this lock tumbler in a counterclockwise direction until the inwardly facing projection 196 on the #1 tumbler contacts the opposite side of the outwardly facing projection 194 on the #2 tumbler. Further rotation of the knob 60 past the 0 position in the counterclockwise direction by the aforesaid second predetermined number of click stops will bring the slot 192 on the #2 tumbler to the uppermost position, and in alignment with the slog 192 on the #3 tumbler. Finally, the knob 60 is rotated in a clockwise direction one full revolution, as indicated by tactile perception of the projection 220, plus a third predetermined number of clicks past the 0 position. After the complete revolution, the inwardly facing projection 210 on the knob 60 has again moved to the opposite side of the outwardly facing projection 194 on the #1 tumbler. Further rotation of the knob 60 by the aforesaid third predetermined number of click stops will bring the slot 192 of the #1 tumbler 182 to the uppermost position and in alignment with the slots 192 on the #2 and #3 tumblers. At this point, all of the slots 192 are aligned and in position to receive the rib 134 on the interposer 120, which can now be depressed allowing the housing 58 to again be moved outwardly relative to the gun barrel 18 or 36; This will cause the gripping hooks 84 to release the bulbous head 70 or 140 in the manner described above, and the unlocking procedure is complete, allowing the gripping and locking assembly 50 to be removed from the gun barrel. The gun is now ready for operation in the normal manner.

Reference has previously been made herein to the fact that the locking mechanism including the feature of being operable solely by tactile perception of relatively movable parts has independent utility apart from the intended purpose of this mechanism in the gun lock device 10 of the present invention. It should be apparent from the foregoing description that the locking mechanism can be utilized in any form of a lock device in which some form of security device can be put into a locked condition merely by mechanical movement of a part, the movement of which is controlled by the locking mechanism described above. For example, the tube 54 and rod 82 can be connected at the remote end of these parts the aforementioned lock device in which the relative movement between these two parts is effective to lock the device. Thus, it is believed that this assembly constitutes an independent invention apart from the utility of this assembly in combination with the other components of the gun lock device 10 as originally contemplated for use in rendering hand guns inoperable.

What we claim and desire to secure by Letters Patent is:

1. A combination lock mechanism adapted to be attached to a device which is capable of being locked to prevent operation of the device, the combination lock mechanism being actuated by elements which have relative movement therebetween which movement can be sensed by tactile perception, said combination lock mechanism comprising:

A. a generally tubular housing having opposite open ends,

B. a lock cage mounted within said housing for relative axial movement with respect thereto and extending through one open end thereof, C. locking means mounted in said housing and connected to said lock cage for axial movement therewith, said locking means including an actuating element projecting from the other open end of said housing and being movable between a first position in which said actuating element is operable to prevent operation of the device to which said combination lock mechanism is attached, and a second position in which said actuating element is operable to permit operation of the device to which said combination lock mechanism is attached, D. an interposer mounted in said lock cage for radial movement between a first position in which said interposer obstructs said axial movement of said actuating element, and a second position in which said interposer permits said axial movement of said actuating element, E. a plurality of settable lock tumblers mounted in said lock cage and operable to permit said radial movement of said interposer when said plurality of lock tumblers are set in individual predetermined positions and to obstruct said radial movement of said interposer when any of said lock tumblers is set in any position other than said predetermined position, F. actuating means mounted on said lock cage adjacent said one open end of said housing for rotary movement relative thereto for setting said tumblers to said individual predetermined positions, and G. tactile perceptive means for providing a tactile indication of whether said combination lock mechanism is in a locked or unlocked condition and of the extent of rotation of said actuating means while said actuating means is setting said plurality of lock tumblers to said individual predetermined positions, whereby the locked or unlocked condition of said combination lock mechanism can be ascertained and said actuating means can be operated to set said lock tumblers in said individual predetermined positions or to move said lock tumblers from said individual predetermined positions to permit said combination lock mechanism to be unlocked and locked, both solely by tactile perception.

2. A combination lock mechanism as set forth in claim 1 wherein said tactile perceptive means comprises A. first tactile perceptive means operatively interconnected between said lock tumblers and said interposer for indicating whether said combination lock mechanism is in a locked or unlocked condition, and B. second tactile perceptive means operatively interconnected between said actuating means and said interposer, and said actuating means and said lock cage respectively for indicating both complete revolutions of said actuating means past a fixed predetermined position, and digital increments of movement of said actuating means less than one complete revolution in either direction of rotation from said fixed predetermined position.

3. A combination lock mechanism as set forth in claim 2 wherein said first tactile perceptive means for providing a tactile indication of whether said combination lock mechanism is in a locked or unlocked condition comprises A. a radial recess formed adjacent the periphery of each of said lock tumblers, and B. an axial projection on said interposer which enters the radial recesses on said lock tumblers when said lock tumblers are in said individual predetermined positions, whereby said radial movement of said interposer from said first position to said second position indicates that said combination lock mechanism is in an unlocked condition, and said radial movement of said interposer from said second position to said first position indicates that said combination lock mechanism is in a locked condition.

4. A combination lock mechanism as set forth in claim 2 wherein said second tactile perceptive means for ascertaining both complete revolutions and digital increments of rotation less than one complete revolution of said actuating means comprises:

A. a first tactile perceptive element disposed in a fixed predetermined position on said interposer, and a second tactile perceptive element disposed in a fixed predetermined position on said actuating means in which said second tactile perceptive element passes closely adjacent to said first tactile perceptive element during rotary movement of said actuating means when said interposer is in said first position such that an operator can sense by tactile perception when said first and second tactile perceptive elements are in alignment during rotation of said actuating means, and B. means operatively interconnected between said actuating means and said lock cage for producing tactile perception of intermittent movement of said actuating means relative to said lock cage as said actuating means is rotated through a given segment of a revolution around said lock cage.

5. A combination lock mechanism as set forth in claim 4 wherein

A. said first tactile perceptive element comprises a finger button disposed on the radially outer end of said interposer for moving said interposer between said first and second positions, and B. said second tactile perceptive element comprises a raised projection formed on the outer peripheral surface of said actuating means closely adjacent to said finger button when said interposer is in said first position, whereby when said actuating means is rotated to set said tumblers, an operator can tell by tactile perception when said first and second tactile perceptive elements are in alignment with each other.

6. A combination lock mechanism as set forth in claim 4 wherein said tactile perceptive means operatively interconnected between said actuating means and said lock cage for producing tactile perception of intermittent movement of said actuating means comprises ball and detent means operatively associated with adjacent faces of said actuating means and said lock cage, whereby said ball and detent means provides a plurality of click stops which an operator can feel during rotary movement of said actuating means relative to said lock cage.

* * * * *